US005673720A

United States Patent [19]

Cuthill

[11] Patent Number: 5,673,720

[45] Date of Patent: Oct. 7, 1997

[54] COLLAPSIBLE STRUCTURE HAVING BIAXIALLY TENSIONED COVER

[76] Inventor: John R. Cuthill, Unit 9/8 Desi Place, Christchurch, New Zealand

[21] Appl. No.: 530,284

[22] PCT Filed: Apr. 15, 1994

[86] PCT No.: PCT/NZ94/00032

§ 371 Date: Dec. 14, 1995

§ 102(e) Date: Dec. 14, 1995

[87] PCT Pub. No.: WO94/24392

PCT Pub. Date: Oct. 27, 1994

[30] Foreign Application Priority Data

Apr. 15, 1993 [NZ] New Zealand ..... 247357

[51] Int. Cl.[6] ..... F04H 15/28

[52] U.S. Cl. ..... 135/98; 135/135; 135/119; 135/907

[58] Field of Search ..... 135/98, 99, 100, 135/124, 128, 134, 135, 137, 147, 158–160, 119, 907

[56] References Cited

U.S. PATENT DOCUMENTS

| | | | |
|---|---|---|---|
| 1,772,646 | 8/1930 | Strombeck | 135/98 |
| 1,820,002 | 8/1931 | Forrester | 135/907 X |
| 2,555,220 | 5/1951 | Brown | 135/98 X |
| 2,928,403 | 3/1960 | Hoskins | 135/907 X |
| 3,751,862 | 8/1973 | Linecker | 135/124 X |
| 4,890,634 | 1/1990 | Dalo et al. . | |
| 5,000,211 | 3/1991 | Speare et al. | 135/100 X |
| 5,394,897 | 3/1995 | Ritchey et al. | 135/124 |

FOREIGN PATENT DOCUMENTS

| | | | |
|---|---|---|---|
| 57115/60 | 2/1962 | Australia . | |
| 61341/80 | 2/1981 | Australia . | |
| 1550072 | 4/1958 | France | 135/160 |
| 2579654 | 10/1986 | France . | |
| 386766 | 12/1923 | Germany . | |
| 2521913 | 11/1976 | Germany | 135/158 |
| 4-213671 | 8/1992 | Japan . | |
| 2136845 | 9/1984 | United Kingdom | 135/135 |

OTHER PUBLICATIONS

Camel 1974 Tent Catalog.

*Primary Examiner*—Lanna Mai

*Attorney, Agent, or Firm*—Oblon, Spivak, McClelland, Maier & Neustadt, P.C.

[57] ABSTRACT

A structure including a collapsible and erectable frame on which a fabric skin is arranged to be mounted in use, the frame having a central hub with pivotal connections from which at least three legs radiate outwardly and downwardly when in the erected position. The central hub incorporates an upwardly projecting first fitting engageable with a central portion of the fabric skin, and each leg has a bend section which is provided with a second outwardly directed fitting and a third outer foot end fitting with which respective intermediate and lower end mounting portions of the fabric skin are engaged. The arrangement provides that the fabric skin is supported clear of contact with the frame except at the outer connections with the fittings and is maintained in a stable biaxial tensioned state by adjustment of the third foot end fitting between first and second positions on movement of a foot end lever.

15 Claims, 6 Drawing Sheets

COLLAPSIBLE STRUCTURE HAVING BIAXIALLY TENSIONED COVER

FIELD OF THE INVENTION

This invention relates to a structure, and more particularly, to a structure comprising a substantially rigid support frame mounting a fabric skin. Examples of this kind of structure include tents, marquees, canopies and awnings.

BACKGROUND ART

In various forms this type of structure have been known for many thousands of years. Improvements on the basic theme have tended to relate generally to one or other of two principle groupings. The two aforementioned groupings are those structures held erect by way of internal poles and a system of outwardly projecting guy ropes and pegs, and those which are free standing, relying almost solely on the strength of the frame to provide support and stability.

Members of both the above noted groups have their disadvantages.

In this connection, structures held erect with internal poles and systems of guy ropes etc require significantly larger areas within which to be set up than their free standing counterparts. Moreover, the internal poles and external guy ropes provide undesirable obstructions which, to a degree, limit the range of applications in which these kind of structures can be used.

On the other hand, free standing structures are generally heavier, more costly, more complex, and/or slower and more difficult to erect. DE 386766, FR 2579654 and U.S. Pat. No. 4,890,634 disclose examples of this group.

DE 386766 more particular relates to a tent frame comprising a central hub splaying outwardly from which are six equispaced legs. When the tent is erected each frame leg is maintained in relative angular orientation with respect to the hub by way of a bracing member. Further, the lower, free end of each leg is intended to be driven into the ground to provide additional stability. The fabric skin is merely draped over the frame to provide a weather proof enclosure.

As will be immediately apparent, the fabric skin is not intended to fulfil a structural function in terms of maintaining the stability of the erected frame.

Failure to utilise the inherent structural capabilities of the fabric skin results in the need for a greater number of legs to achieve a stable configuration, thus resulting in a more complex and heavier structure than might otherwise be required. Moreover, cross bracing, in this case provided by the ground, is necessary to maintain the spacing of the legs.

The subject matter of FR 2579654 is a modular shelter structure made of wood and fabric. The structure is hexagonal in shape. The roof portion comprises a central hub from which radiate six rafters. A fabric skin covers the roof portion, and is stretched between the outer ends of the rafters and a pole upstanding from the central hub.

It is to be noted that although the fabric skin may be stretched in biaxial stable tension, this has not been fully utilised, as cross bracing (20') is provided to spread the outer ends of the rafters and maintain the hexagonal shape of the whole. These additional members, as well as the need for six rafters, increases the overall complexity and weight of the structure. Such considerations are of less importance to a structure of this kind, which appears to be intended for longterm or semi-permanent use.

U.S. Pat. No. 4,890,634 describes a framework forming a support for the fabric skin of a light shelter. The framework comprises a base member in the form of a regular polygon, and a central pole maintained in position by a plurality of support arms, two extending to each side of the base member. The fabric skin is stretched over the central pole and is hooked along the edges of the base member. As with the structures of FR 2579654 and DE 386766, the frame of this patent specification is complex, requiring lateral bracing between the radiating support arms.

Overlaid upon the aforegoing disadvantages are the problems and advantages associated with modularity in this type of structure.

By way of explanation, the term "modularity" is used to describe the ability of a particular structure to interconnect with one or more further structures of substantially the same kind to construct a larger composite unit.

It will readily be appreciated that structures adapted to combine in modular fashion enable significant advantages in terms of utility to be obtained.

To date, with few exceptions, structures of this kind have been modular in the sense that they can extend in length but not width. So far attempts to provide modularity with respect to both width length have either failed because of water seal and run difficulties between apex roof sections, or have succeeded at the cost of providing very large, highly specialised fittings to fill in apertures at great height.

It is an object of the present invention to provide a structure which overcomes at least one of the above noted problems.

SUMMARY OF TEE INVENTION

In a first broad aspect of this invention, there is provided a structure frame onto which a fabric skin can be mounted, the frame comprising at least three legs radiating outwardly from a central hub, wherein at least two of the legs are equidistant from the third leg and wherein each leg comprises a first end pivotably connected to the hub, a first elongate member extending from the first end, a bend section mounted at the other end of the first elongate member, and a second elongate member extending from the bend section, terminating in a foot member, there being provided a first fitting upstanding centrally of the hub for engaging with a mounting portion of a said fabric skin, a second fitting located adjacent and extending outwardly of each bend section for engaging further mounting portions of said fabric skin, and a third fitting located adjacent and extending outwardly of each foot member for engaging further mounting portions of said fabric skin, the frame, when fully erected with a said fabric skin mounted thereon, is adapted to contact the said fabric skin only at the front, second and third fittings, and to maintain the said fabric skin in biaxial tension between the said first, second and third fittings.

Maintaining the fabric skin under biaxial tension provides significant benefits. For example, contact with the frame is only at specific points, rather than continuous, thus the stresses on the frame can be concentrated and controlled more effectively. In this regard, horizontal spreader or eave rails may be dispensed with, providing consequential savings in cost, weight and complexity.

Moreover, with the legs of the frame pivoting at the hub the whole structure may operate for cartage and storage in much the same way as an umbrella, which has significant effects on assembly and erection times. Preferably, there are four legs radiating from the central hub.

Desirably the structure frame is formed as a unit which can be collapsed down for transportation to and from a site.

Advantageously the distance between the first and all of the second fittings is adjustable.

Conveniently the distance between the second and third fittings is adjustable.

The angle of the bend section can be fixed, or optionally may be variable.

In a second broad aspect of this invention there is provided a structure comprising a frame according to the first broad aspect on which is mounted a said fabric skin.

Desirably, the quarter walls of the fabric skin between two adjacent legs of the frame provide an arch like opening, thereby facilitating the stable distribution of stresses between the fabric skin and the frame.

Preferably the structure is entirely free standing.

In a third broad aspect of this invention there is provided a modular construction system comprising at least two structures according to the preceding aspect interconnectable by way of a connecting strip capable of transmitting biaxial tension between the skins of adjacent structures.

Desirably all of the quarter walls of at least one of the structures are substantially identical and at least one quarter wall of one or more of the other structure or structures is substantially identical to the quarter walls of the first said structure.

Preferably the connecting strip interconnects the quarter walls of two adjacent structures so that the connection of the quarter wall of one structure to the quarter wall of an adjacent structure forms an arch.

The arch formed between the two adjacent structures provides a satisfactory connection under which free egress may be obtained. Where the structures of the system all have substantially identical quarter walls structures may be interconnected in all directions virtually ad infinitum.

Desirably the connecting strip connects with each quarter wall along the full length of the joint to provide a tight waterproof seal.

Conveniently the connection can be by way of a hook and loop type connector, such as, for example, VELCRO™. Alternatively, other know fabric connectors, such as zips, hooks and ropes or latches may be used.

BRIEF DESCRIPTION OF THE DRAWINGS

A preferred embodiment of the invention will now be described, by way of example only, with reference to the accompanying drawings, in which.

DESCRIPTION OF THE PREFERRED EMBODIMENT

Figures 1A, 1B:
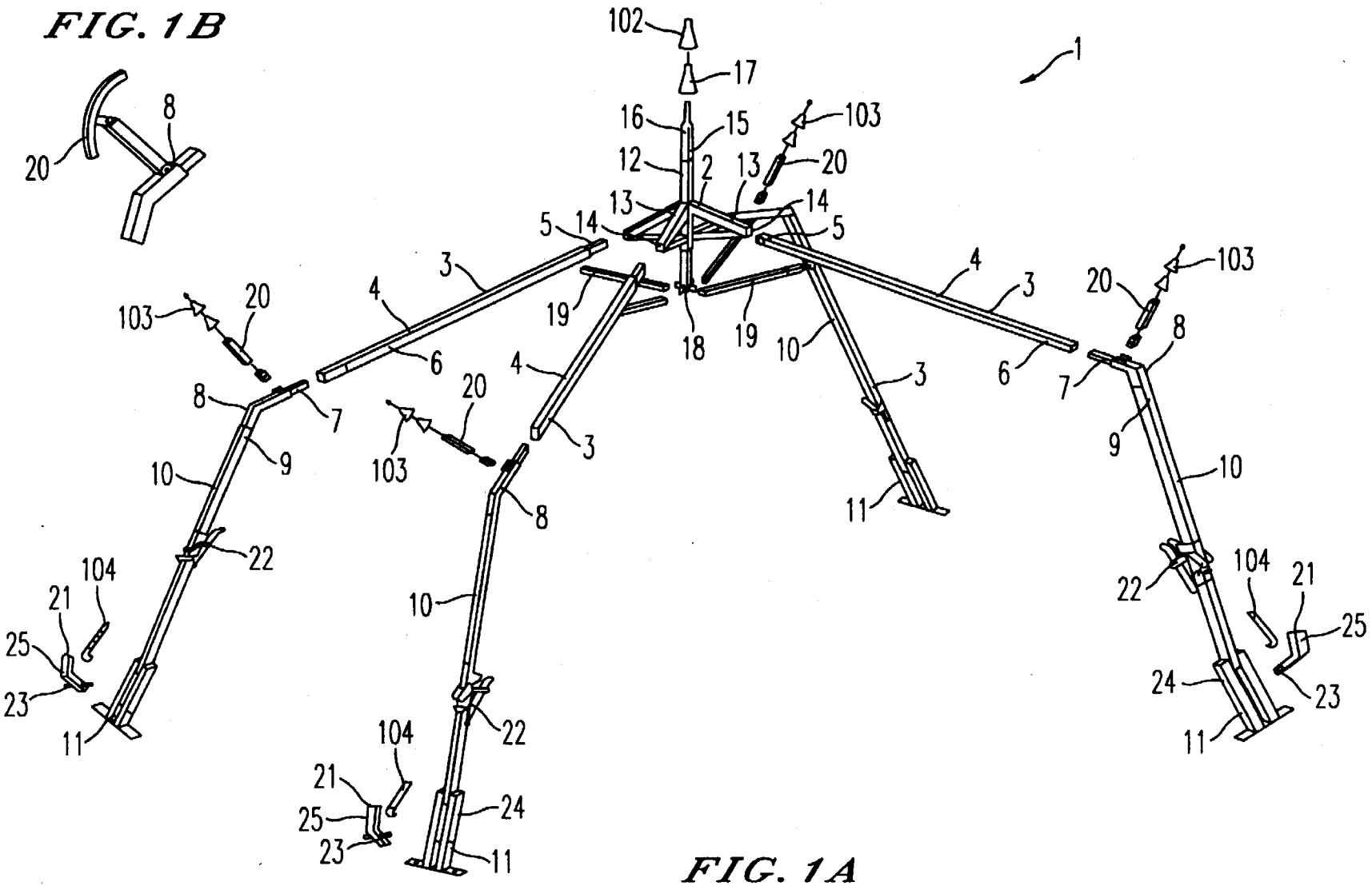
FIG. 1*a* is an exploded perspective view of a structure frame in accordance with the present invention.
FIG. 1*b* shows alternative configurations of the second fitting.

Referring firstly to FIGS. 1*a* and 1*b*, as illustrated, in accordance with the present invention there is provided a frame, as generally indicated at 1, onto which a fabric skin can be mounted.

The frame 1 comprises a central hub 2, outwardly from which radiate four legs 3.

Each leg 3 comprises a first elongate tubular member 4 which has a first end 5 pivotably connected to the hub 2. The other end 6 of the member 4 is adapted to receive an end 7 of a bend section 8. The other end 9 of the bend section 8 is connected to a second elongate tubular member 10. The free end of the member 10 terminating in a foot portion 11.

Optionally the members 4, 10 can be formed as a single section, or can be made up of two or more interconnecting elements for ease of construction, handling and transportation.

Further, while the bend section 8 can be of a fixed angle, and connected to the member 10, having an end 7 slidably engageable with the end 6 of the member 4, other configurations are possible. In this regard, the bend section 8 may comprise a pivot joint between the members 4, 10, which joint is lockable at a predetermined angle.

The hub 2 comprises a hollow tube 12, radiating perpendicularly outwardly from which are four arms 13. Each arm 13 terminates in a hinge fitting 14 to which the end 5 of the corresponding leg 3 is pivotably attached.

Extending slidably through the tube 12 is a flexible shaft 15 having a free end 16 adapted to form the apex of a structure created when a fabric skin is applied to the frame 1. In this regard, the end 16 comprises a first fitting 17 engageable with the fabric skin. Positioning of the shaft 15 relative to the tube 12 may be fixed or adjusted by way of a locking means (not shown), such as for example a screw or the like.

Once the position is determined it can be maintained by way of a padlock of the like, to ensure that the frame 1 is not collapsed by an unauthorised person. Pivotably connected to the other end 18 of the shaft 15 are four bracing elements 19. Each element 19 is also pivotably connected to a corresponding one of the members 4 of the legs 3.

For convenience of manufacture and assembly/disassembly the shaft may be comprised of three sections, a first section extending from the top end of the tube 12 corresponding to the free end 16, a second section slidable within the tube 12, and a third section depending from the bottom end of the tube 12 corresponding to the end 18.

Extending outwardly from each bend section 8 is a second fitting 20 engageable with the fabric skin. FIG. 1*b* illustrates one of a number of possible alternative embodiment of the fitting 20.

Mounted on each foot portion 11 is a third fitting 21 for engaging with the fabric skin.

To facilitate tensioning of the fabric skin over the frame 1 the second elongate tubular member 10 of each leg 3 is able to bend at approximately its' midpoint, thereby allowing the second and third fittings 20 and 21, respectively, to be moved closer together, or further apart. Bending and locking is achieved by way of a pivot and lock mechanism 22.

Fitting 21 comprises a lever 23 pivot mounted to the main body 24 of the foot portion 11. The lever 23 includes a pin 25, to which the fabric skin can be attached, located outwardly of the lever pivot point. The positioning of the pin 25 allows the lever 23 to be actuated to draw the fabric skin tight.

Figure 6A:
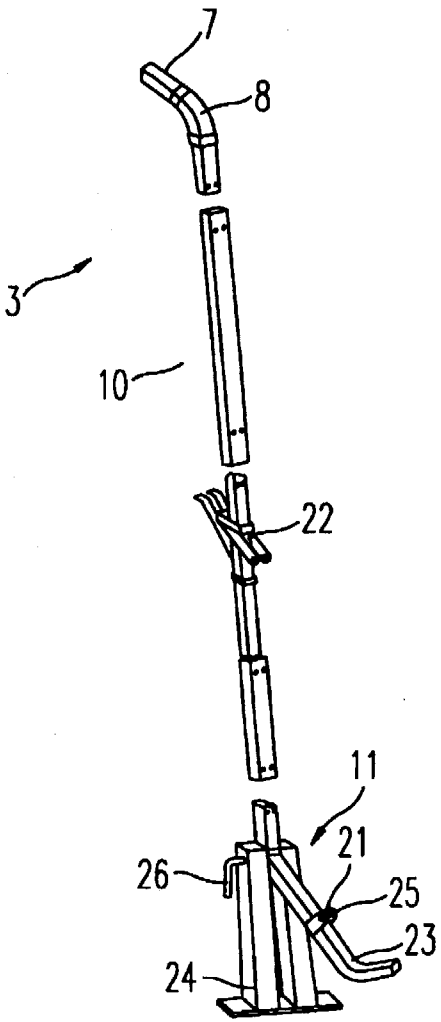
FIG. 6*a* shows a front perpective view of an alternative construction for the foot portions of the structure frame of FIG. 1*a;*
Figure 6B:
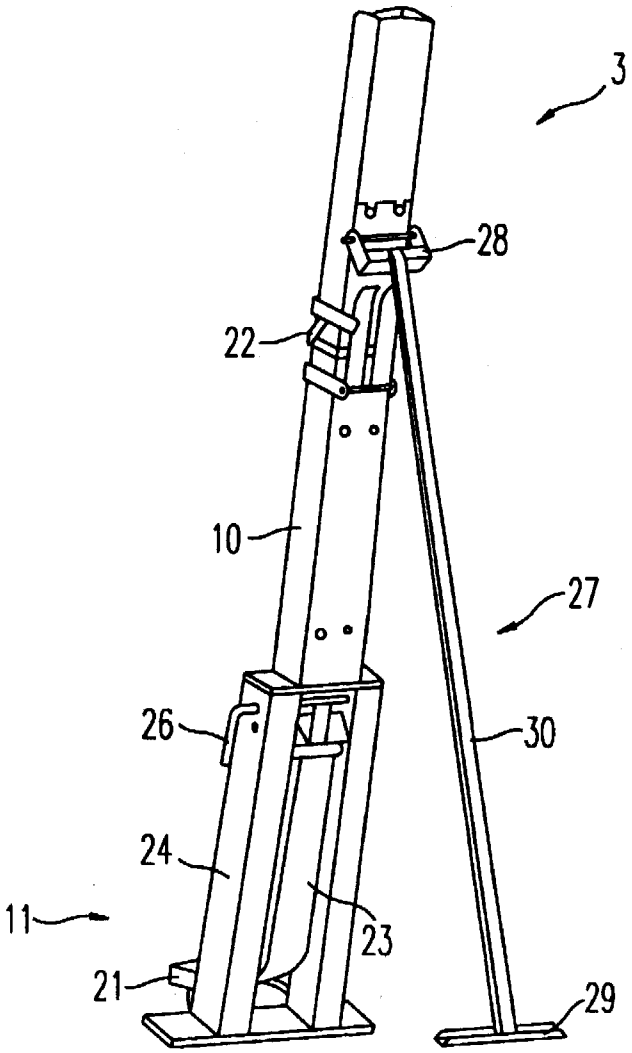
FIG. 6*b* shows a rear perspective view of the foot portion of FIG. 6*a*, including a storm strut fitted thereto; and, FIG. 7 illustrates a side elevation of a wall section suitable for use with the structure of FIG. 2*a* or 2*b*.
Figure 7:
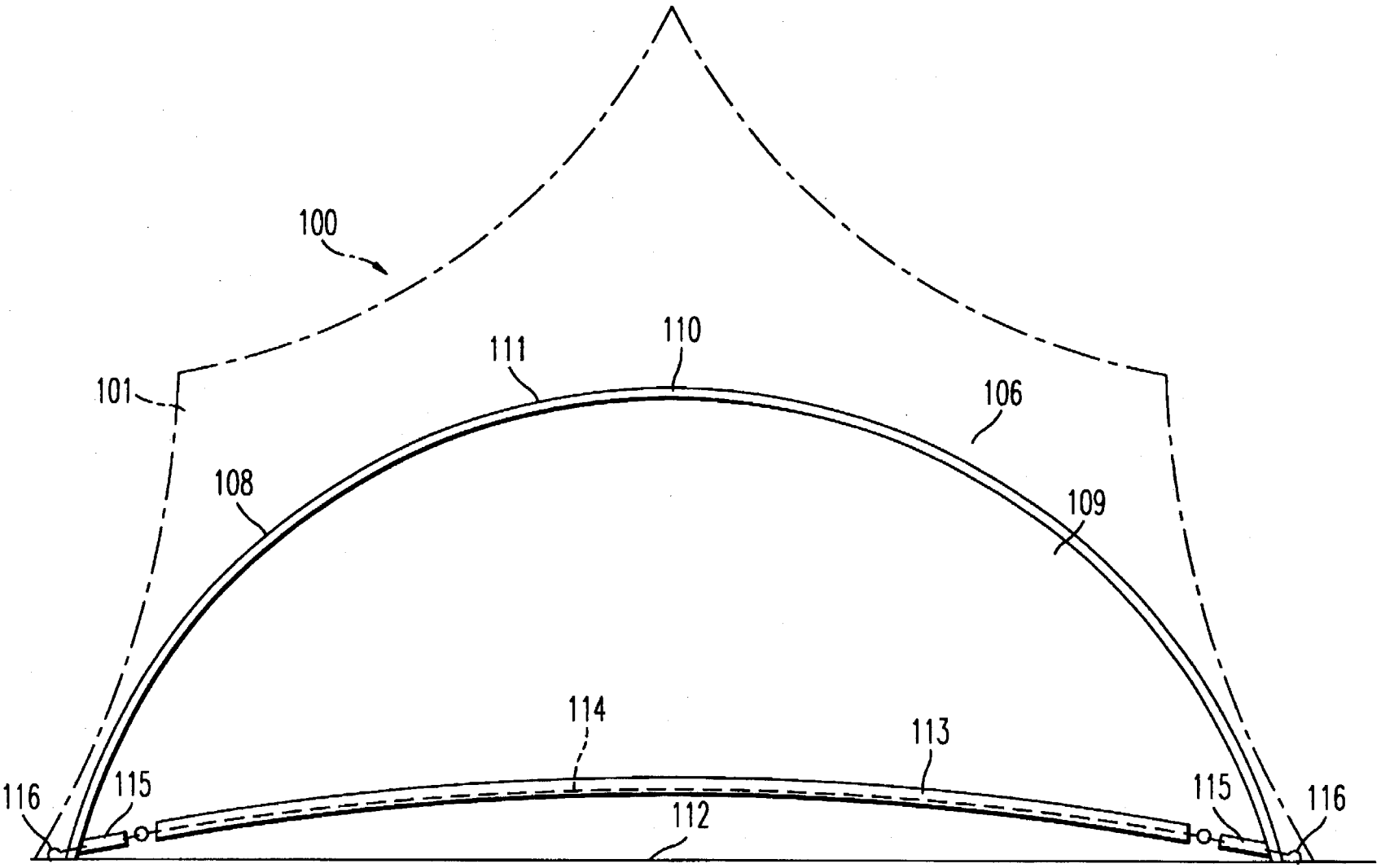

Referring additionally now to FIGS. 6*a* and 6*b*, the foot section 11 can include a self-locking mechanism 26 for the lever 23, allowing convenient substantially hands free foot operation.

As an additional safety feature a strut 27 can be fitted to each leg 3 to prevent excessive flexing of the frame 1 in high or blustery wind conditions. Each strut 27 comprises a pivoting mounting head 28, mountable on the member 10 of a leg 3 above the pivot and lock mechanism 22, a ground engaging support plate 29, and a rigid elongate bracing member 30 extending therebetween.

Figure 2A:
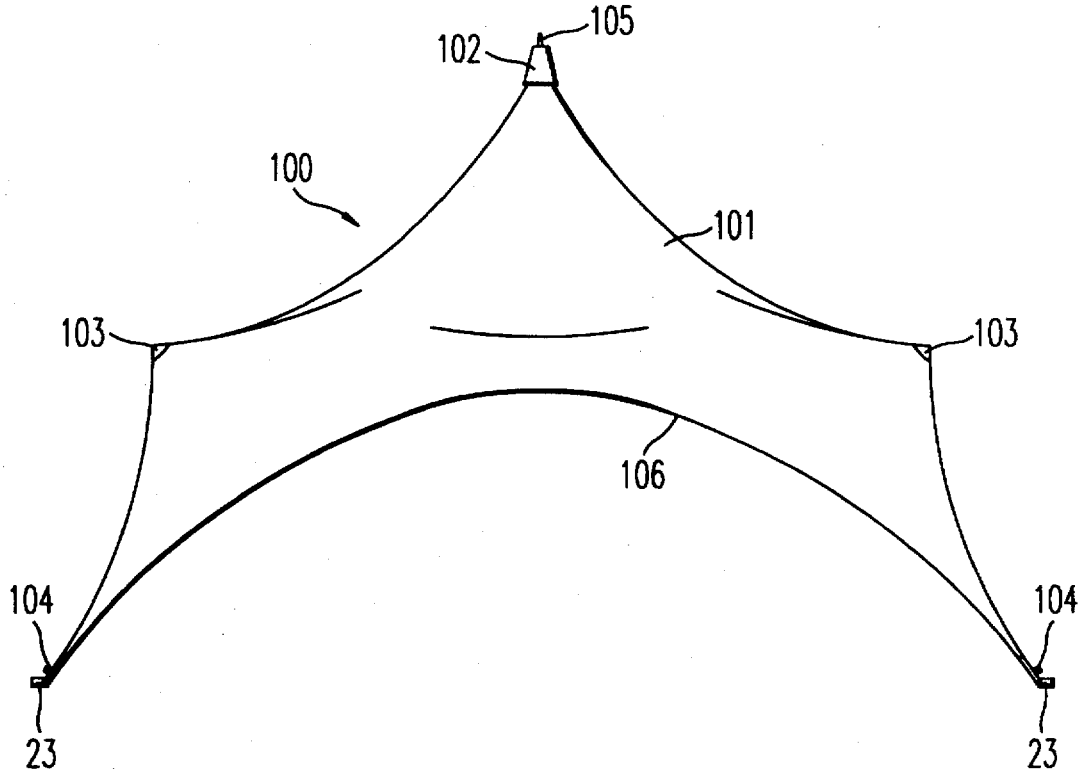
FIG. 2*a* is a side elevation of a structure in accordance with the present invention incorporating second fittings of the form illustrated in FIG. 1*a;*
Figure 2B:
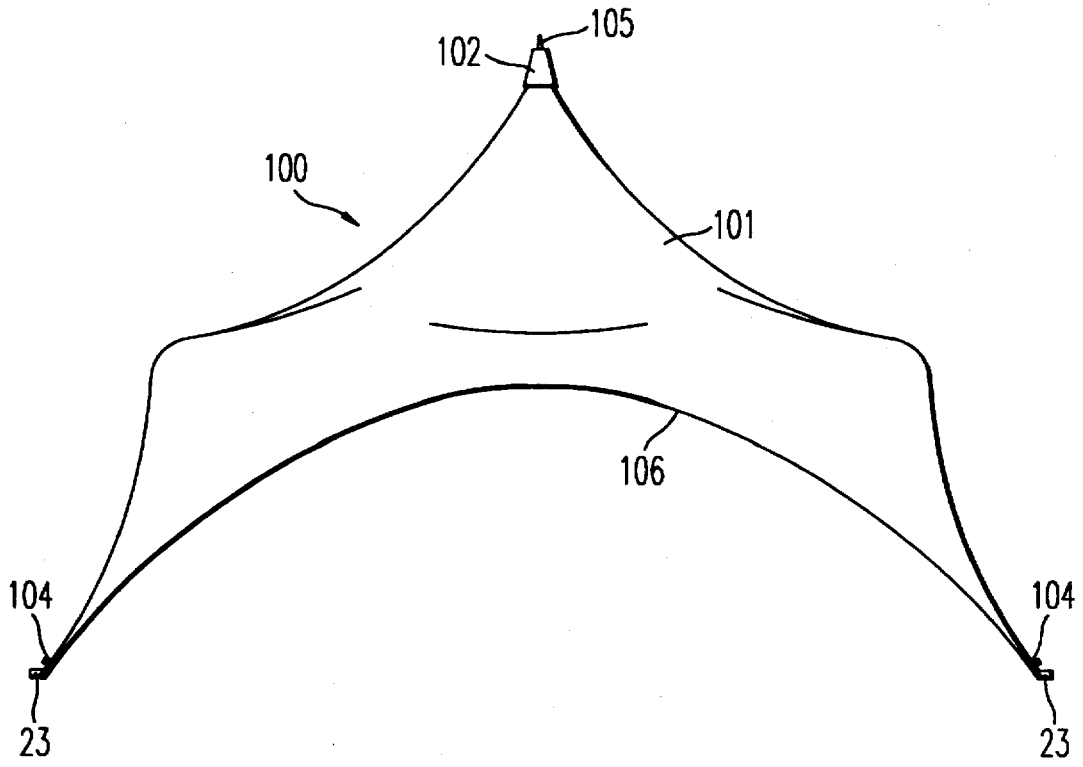
FIG. 2*b* is a side elevation of a structure in accordance with the present invention incorporating second fittings of the form illustrated in FIG. 1*b;*
Figure 3:
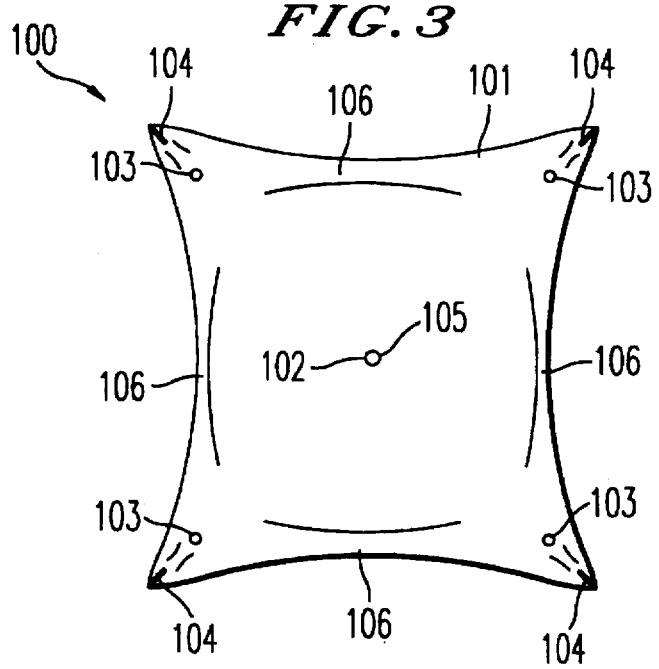
FIG. 3 illustrates a plan view of the structure of FIG. 2*a;*

Turning also to FIGS. 2*a*, 2*b* and 3, a completed structure, as generally indicated at 100, comprises a fabric skin 101 stretched over a frame 1.

The only points of contact between the skin 101 and the frame 1 are at each of the first, second and third fittings 17, 20 and 21, respectively.

As shown in FIGS. 2*a* and 3, the skin 101 is held in biaxial tension on the frame 1 crown and eave caps 102 and 103, respectively, onto fittings 17 and 20, respectively, and by way of a mounting hook (not shown in FIGS. 2*a*, 2*b* or 2, but indicated as 104 in FIG. 1*a* and 6*a*) attached to the pin 25 of each fittings 21. In the structure of FIG. 2*b* eave caps 103 are not required, and the fitting 20 can rest directly against the skin 101, although some additional local strengthening of the fabric skin is desirable. Additional local strengthening of the skin 101 adjacent the crown cap 102 and hook 104 is also highly desirable regardless of the nature of the fitting 20.

As will be noted from the drawings, the structure 100 has an apex 105 formed at the crown cap 102. From the apex 105 the fabric of the skin 101 drapes, under biaxial tension, outwardly to the eave caps 103. The skin is then drawn, under tension, between the hooks 104 and the eave caps 103. Between adjacent hooks 104 the skin 101 forms an arched quarter wall 106.

With the fabric skin 101 under biaxial tension the legs 3 of the frame 1 are retained in stable relative location and indeed the entire structure 100 is maintained in coherent stability without the need for guy ropes or retaining pegs. Of course, in windy conditions it would be wise to peg the structure 100 down, via the foot portions 11 of the frame 1.

It will be appreciated that as the skin 101 is maintained in stable biaxial tension, and only contacts the frame 1 at a minimum number of points, no annoying flapping of fabric etc occurs.

To erect the structure 100 the frame 1 is first assembled. Next each of the members 10 of the legs 3 are each bent by way of their pivot and lock mechanism 22. The shaft 15 is then drawn down through the tube 12 of the hub 2 so that the legs 3 are extended outmost, but the distance between the first and second fittings 17 and 20, respectively, is at a minimum.

The fabric skin 101 is overlaid on the frame 1 and engaged with the fittings 17 and 20. Next the shaft 15 is pushed up through the tube 12 to tension the skin between the fittings 17 and 20. The skin is then engaged with the fittings 21, the elongate tubular members 10 straightened out, and the levers 23 actuated thereby tensioning the skin 101 between the fittings 20 and 21.

Once the structure 100 has been set up for the first time the fabric skin 101 can be left connected to the first fitting 17, so that in future the structure 100 is erected much like an umbrella.

To facilitate handling when the structure 100 is being disassembled the crown cap 102 can be provided with a plate (not shown) having four apertures or the like, each for receiving a clip (not shown) mounted to the fabric skin 101 adjacent hook 104. This enables the fabric skin 10 to be securely and neatly fastened during packing of the structure 100 for transport or storage.

Figure 5:
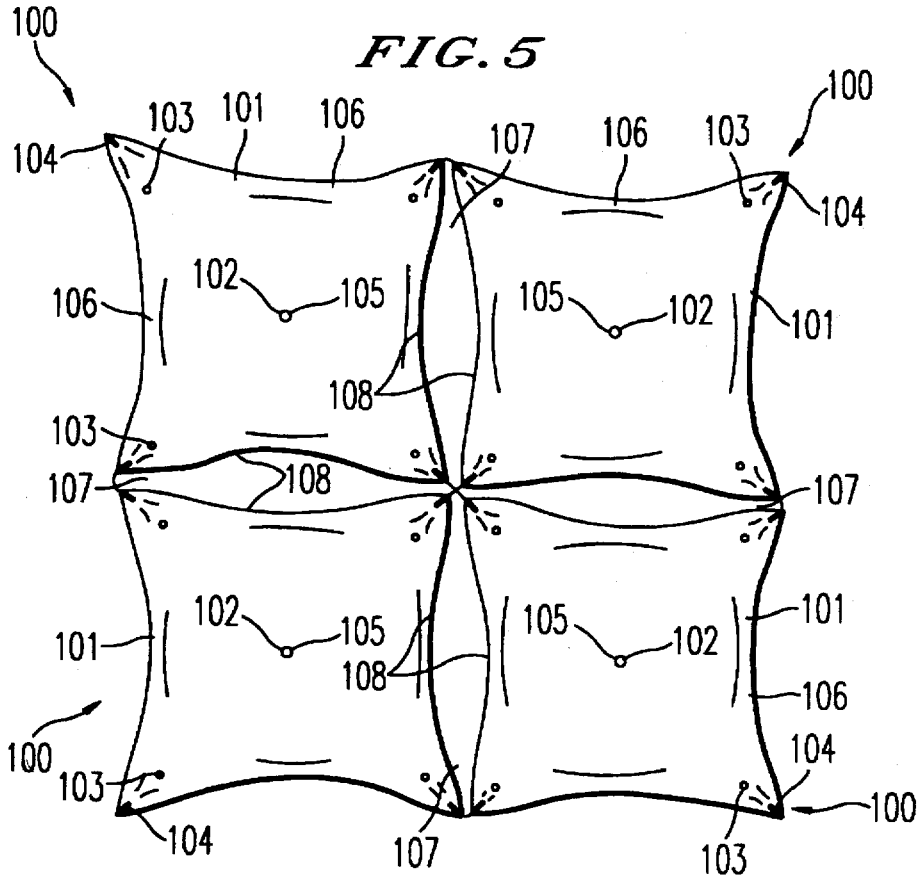
FIG. 5 illustrates a plan view of four structures as shown in FIG. 2*a* interconnected by connecting strips.
Figure 4:
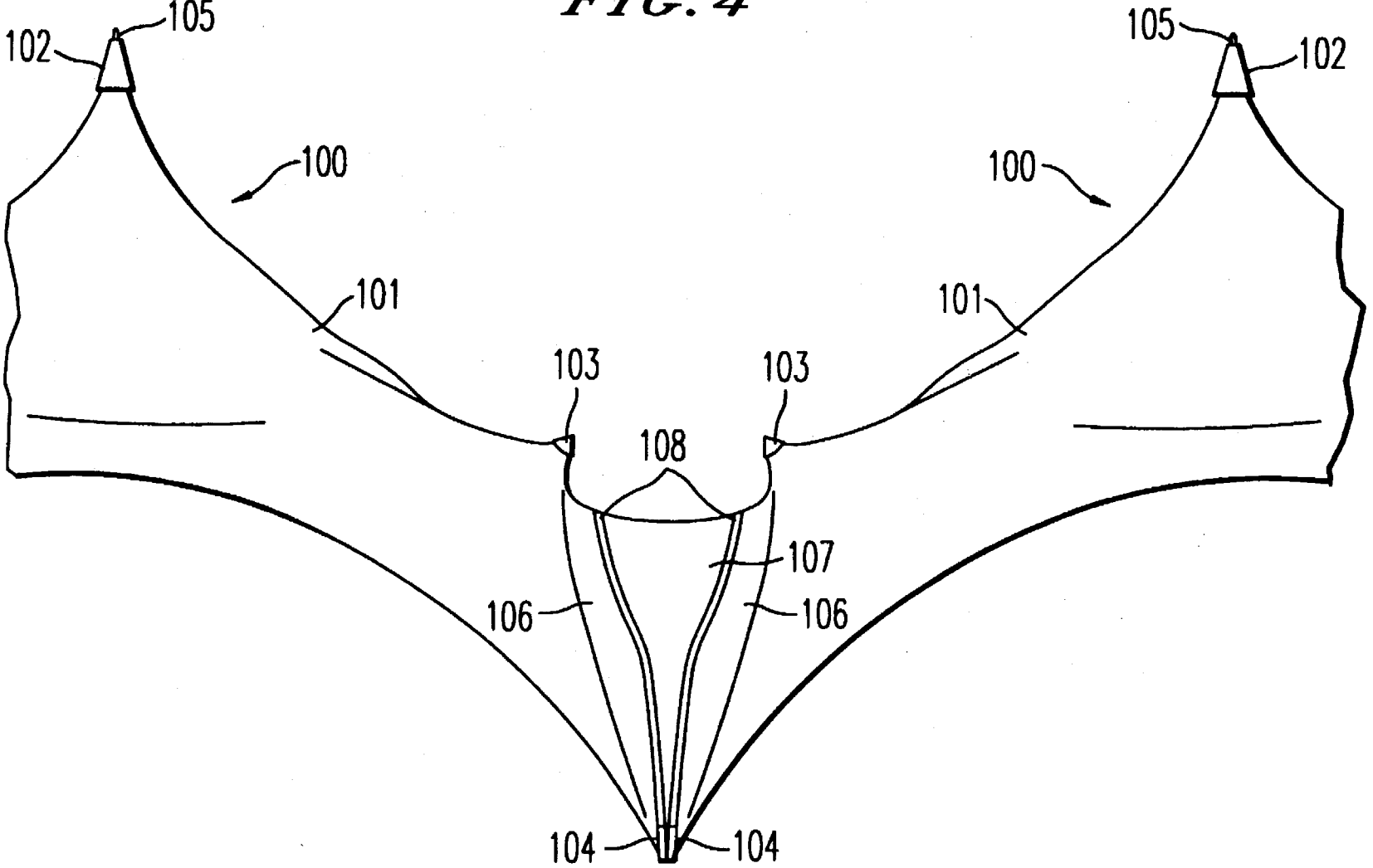
FIG. 4 illustrates a side elevation of two structures as shown in FIG. 2*a* jointed by a connecting strip.

With reference now also to FIGS. 4 and 5, a plurality of the structures 100 may be positioned adjacent each other, as shown in FIG. 5. The number of structures 100 is unlimited and the resulting composite unit may be added to in any direction laterally or longitudinally.

Adjacent structures 100 are joined using a connecting strip 107. The strip 107 engages with the adjacent quarter walls 106 by way of a hook and loop type connector 108, such as for example VELCRO™. The connector 108 involves having the hook part mounted on the interior side of each quarter wall 106 and the loop part mounted on the connecting strip 107 (or vice versa). The connector 108 runs the full length of each side of the strip 107 to provide a high strength easily created joint. The joint must be strong enough to transfer biaxial tension from one quarter wall 106 to the other.

It will readily be appreciated that the connector strip 107 provides a simple and effective way of joining adjacent structures 100, providing a strong waterproof seal.

If desired half size structures 100, that is structures having two opposite sides half the length of the other two sides may be employed at the edges of a composite unit.

The opening beneath each quarter wall 106 can be closed in if desired utilising a wall section 109. The wall section 109 is configured to precisely match the opening beneath the quarter wall 106, and has a part of a hook and loop type connector 110 along the full length of the curved upper edge 111 which can be engaged with the portion of the connector 108 mounted on the interior side of the quarter wall 106.

Extending between the ends of the lower edge 112 of the wall section 109 is a curved pocket 113, the relative position of the high point in the curve of the pocket 113 corresponding to the high point in the curve of the upper edge 111. A wire, or some other flexible cord, 114 is located in the pocket 113, running the full length thereof. Attached to either end of the wire 114 is a shortening mechanism 115, and an attachment hook 116 whereby the wire 114 can be attached to the adjacent foot portion 11 of the frame 1, or to a peg (not shown). The wire 114 can be shortened using the mechanisms 115, having the effect of drawing the wall section 109 downwards and tensioning it against the quarter wall 106. The resulting stiffness and tension eliminates the need to peg down the bottom of the wall section 109, and ensures a smooth appearance.

The fabric skin 101 can be formed from PVC based textiles, polyester based textiles, or any other type of soft flexible sheet used in the industry.

Desirably the components of the frame 1 should be formed from a light weight material, such as aluminium alloy or the like, however, steel or materials such as carbon fibre may also be used.

Additional advantages of the present invention will become apparent to those skilled in the art after considering the principles in particular form as discussed and illustrated.

Accordingly, it will be appreciated that changes may be made to the above described embodiment of the invention without departing from the principles taught herein.

For example, it will be understood that the number of the sides of the structure may be varied to advantage in some cases. In some situations a three sided structure using the principles described may be preferred. Equally five, six or more sided structures may be required. Moreover, the lengths of the sides may be different.

Finally therefore, it will be understood that this invention is not limited to the particular embodiment described or illustrated, but is intended to cover all alterations, additions or modifications which are within the scope of the following claims.

I claim:

1. A collapsible and erectable structure support frame onto which a fabric skin of complimentary dimensions is mounted when erected, the frame comprising at least three legs radiating outwardly from a central hub, wherein at least two of the legs are equidistant from the third leg and wherein each leg comprises a first end pivotably connected to the hub, a first elongate member extending from the first end, a bend section mounted at the other end of the first elongate member, and a second elongate member extending from the bend section, terminating in a foot member; characterised in that there is provided a first fitting upstanding centrally of the hub to have an outer upper end potion engaging a central mounting portion of said fabric skin, a second fitting located adjacent and extending outwardly of each bend section to have an outer end portion engaging a respective intermediate mounting portion of said fabric skin, and a third fitting located adjacent and extending outwardly of each foot member to have an outer portion engaging a respective lower mounting portion of said fabric skin, the frame, when fully erected with said fabric skin mounted thereon, contacting the mounting portions of said fabric skin only at outer potions of the first, second and third fittings, and to support the fabric skin in clear spaced relationship from the legs; each said third fitting being mounted on a lever extending from a pivotal connection with the respective foot member for movement between a first position at which the fabric skin is held in a tight but not fully tensioned state, to a second position by the application of force to fully tension the fabric skin between the first fitting and respective second and third fittings, and there being locking means to lock the respective levers and third fittings in their second positions.

2. A structure frame according to claim 1 wherein there are four legs radiating from the central hub.

3. A structure frame according to claim 2 wherein the legs are spaced at 90° intervals.

4. A structure frame according to claim 1 wherein the distance between the first and all of the second fittings is adjustable.

5. A structure frame according to claim 4 wherein the distance between the second and third fittings is adjustable.

6. A structure comprising a structure frame according to claim 1 on which is mounted said fabric skin as a combination assembly: said assembly being erectable for use and collapsible for transportation and storage optionally with or without detachment of the fabric skin from its mounting connections with the frame fittings.

7. A structure according to claim 6 wherein a wall portion of the fabric skin extending between any two adjacent legs of the structure frame is shaped to provide an arch like opening which maintains its shape under the biaxial tensioned state of said fabric shape when the structure is fully erected and the fabric skin tensioned by the respective levers and third fittings.

8. A structure according to claim 7 wherein, all the wall portions of the fabric skin between respective adjacent pairs of legs are in biaxial tension and provided with similar arch like openings.

9. A modular construction comprising a plurality of erected structures according to claim 8 located in juxtaposition with the arch like openings of any adjacent two structures located in aligned opposition and interconnected by a shaped connecting strip having opposite peripheral edge portions joined at the respective arch like opening peripheries and in a manner transmitting biaxial tension between the fabric skins of the connection structures.

10. A modular construction comprising at least two erected structures according to claim 7, located in juxtaposition with their arch like openings aligned in opposition and being interconnected by way of a complimentary shaped connecting strip having opposite peripheral edge portions joined at the respective arch like opening peripheries so as to be capable of transmitting biaxial tension between the fabric skins of the two structures.

11. A modular construction according to claim 10 wherein the fabric skin wall section and arch like opening of one structure is substantially identical in size and shape to the adjacent opposing wall section of the adjacent structure.

12. A modular construction according to claim 11 wherein the connecting strip connects with each opposing wall section along substantially the full length of its opposite peripheral edges to provide a tight water proof seal thereat.

13. A modular construction according to claim 10 wherein connection of the connecting strip to each opposing wall section is by way of a hook and loop type fastener extending substantially the full length of each of the opposite peripheral edges.

14. A modular construction according to claim 10, wherein connection of the connecting strip to each opposing wall section is by way of a zip fastener extending substantially the full length of each of the opposite peripheral edges.

15. A structure frame according to claim 1, wherein the second fitting at each bend section is pivotably mounted for angular adjustment on tensioning of the fabric skin.

* * * * *